United States Patent [19]

Martin

[11] 3,941,371

[45] Mar. 2, 1976

[54] SHEET GLASS CONVEYING, CLASSIFYING & STACKING APPARATUS

[75] Inventor: John K. Martin, Monterrey, Mexico

[73] Assignee: Fabricacion de Maquinas, Monterrey, Mexico

[22] Filed: Mar. 20, 1975

[21] Appl. No.: 560,375

[52] U.S. Cl. ..... 271/64; 271/184; 271/195; 214/6 D

[51] Int. Cl.[2] ..... B65H 31/24; B65H 29/24

[58] Field of Search ..... 271/64, 174, 184, 185, 271/194, 195, 225; 214/6 D; 198/81

[56] References Cited

UNITED STATES PATENTS

| | | | |
|---|---|---|---|
| 3,430,950 | 3/1969 | Marsh et al. | 271/64 |
| 3,880,297 | 4/1975 | Martin | 214/6 D |
| 3,880,420 | 4/1975 | Martin | 271/184 |

*Primary Examiner*—Evon C. Blunk
*Assistant Examiner*—Robert Saifer
*Attorney, Agent, or Firm*—Kemon, Palmer & Estabrook

[57] ABSTRACT

A plurality of transfer conveyors are arranged at right angles to and spaced along a main conveyor for transferring selected sheets from said main conveyor and either dropping them in a reject bin or stacking them in separate piles depending upon the size of the sheets. The transfer conveyors overlie the main conveyor and operate to pick up sheets from the main conveyor by Bernoulli's principle and permit them to slide by gravity to the reject bin while supported in non-contacting relation by the nozzles. The nozzles are selectively actuated in groups to achieve the pickup and reject functions. Sheets not rejected leave the lower end of the transfer conveyor and fly free to the stack receiver which is positioned in line with the conveyor and spaced outwardly therefrom.

4 Claims, 4 Drawing Figures

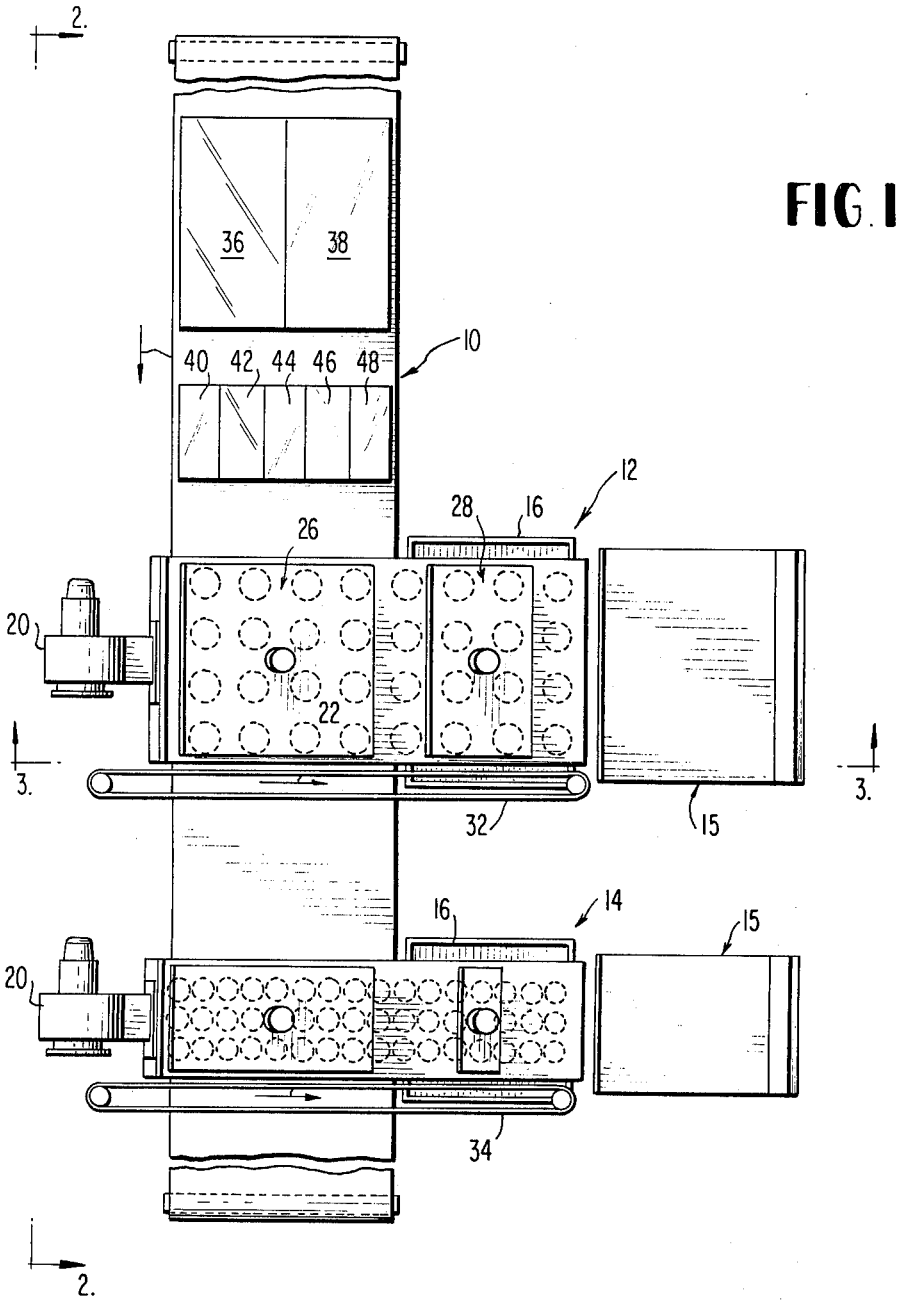
FIG. 1
FIG. 2
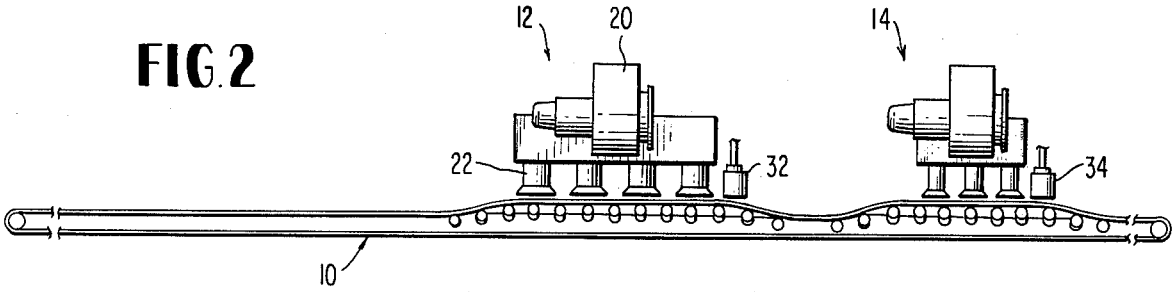

SHEET GLASS CONVEYING, CLASSIFYING & STACKING APPARATUS

BACKGROUND OF THE INVENTION AND CROSS REFERENCE TO RELATED ART

The use of a transfer means operating on Bernoulli's principle and useful for stacking material such as freshly silvered glass mirrors where the mirrors are advancing along a conveyor is shown in applicant's co-pending applications Ser. No. 450,770 filed Mar. 13, 1974 now U.S. Pat. No. 3,880,297 and Ser. No. 552,288 filed Feb. 24, 1975. The apparatus disclosed in the later of these two prior applications utilizes a plurality of Bernoulli transfer conveyors and the path of travel of the articles on the transfer conveyors is substantially at right angles to the direction of their path of travel on the feed conveyor which brings them from the manufacturing location to the general area of the stacking apparatus. Each transfer conveyor has one end overlying the feed conveyor and the other end overlying the reject bin.

BRIEF SUMMARY OF THE INVENTION

In accordance with the present invention, a plurality of conveyors of the same type disclosed in the aforementioned application Ser. No. 552,288 filed Feb. 24, 1975 are arranged at right angles to the feed conveyor and spaced from each other along the path of travel of the feed conveyor. In this instance, however, the transfer conveyor terminates at about the outer boundary of the reject bin. Application of well known sorting principles such as employed in main sorting machines, is effective to selectively actuate the transfer conveyors at a time corresponding to the arrival at each transfer conveyor of those sheets which it is desired to stack at that particular location. A reject bin is also positioned between the feed conveyor and the stacking apparatus underneath each transfer conveyor so that defective sheets may be prevented from reaching the stack with those that are perfect. Perfect sheets, on the other hand, leave the transfer conveyor and "fly" from the outboard end of the transfer conveyor to the stack receiving means. Their flight path is parabolic and for reasons which are not clear, a gradually increasing separation between adjacent sheets occurs between the time they are picked off the feed conveyor and the time they land on the stack receiving means.

BRIEF DESCRIPTION OF THE DRAWINGS

FIG. 1 is a top plan view of a feed conveyor and a pair of transfer conveyors in accordance with the present invention;

FIG. 2 is a view on the lines 2—2 of FIG. 1;

DETAILED DESCRIPTION OF THE DRAWINGS

Figures 3, 4:
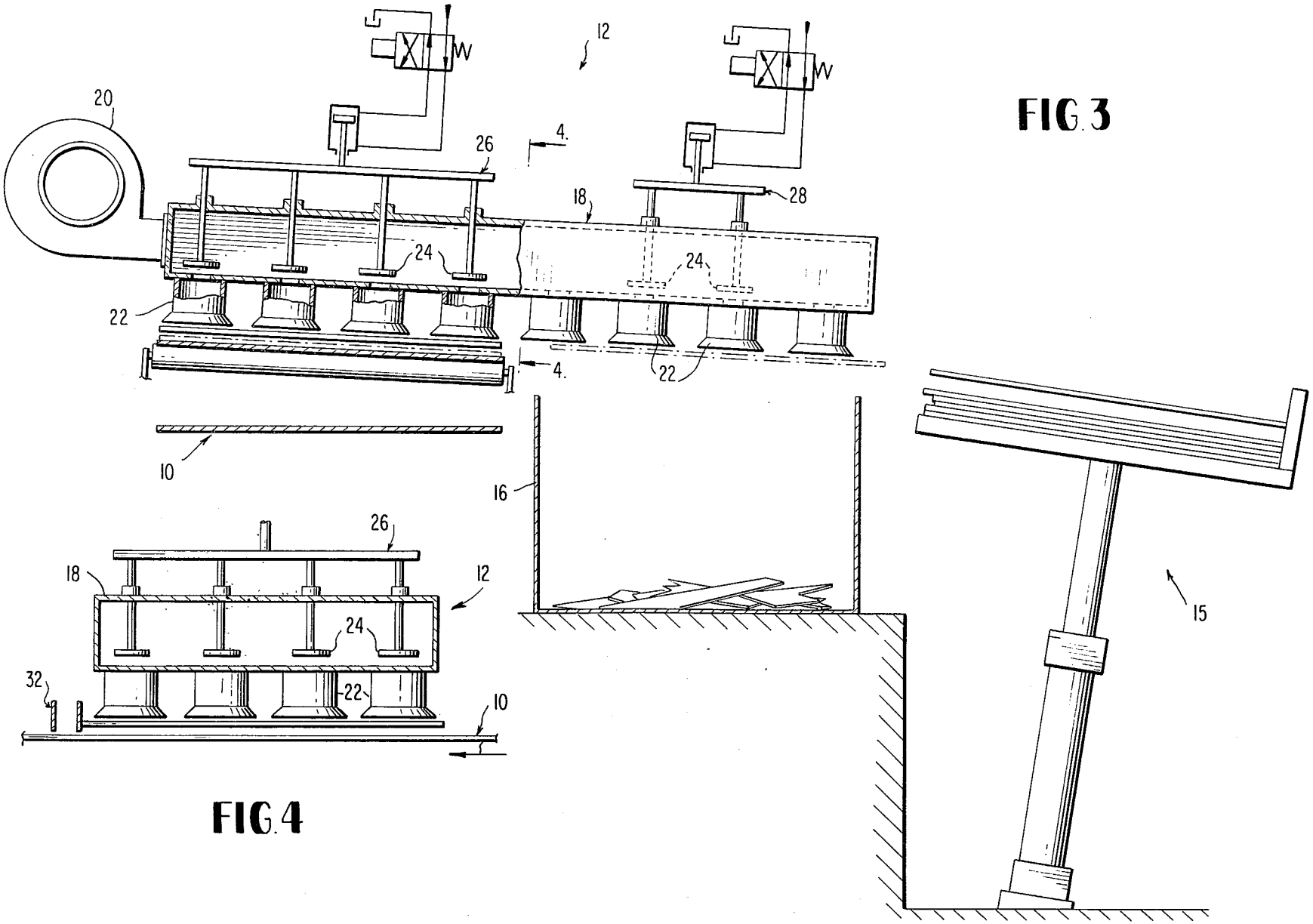
FIG. 3 is a view on the lines 3—3 of FIG. 1.
FIG. 4 is a view on the lines 4—4 on FIG. 3.

Referring first to FIG. 1, the feed conveyor 10 is loaded (by means not shown) with sheets of glass of different sizes for travel in the direction indicated. Sheets of a given size are arranged on the conveyor 10 in side by side relation as indicated. A pair of transfer conveyors indicated generally by the numerals 12 and 14 are arranged along the path of travel of the conveyor 10 and spaced from each other. Although only two such transfer conveyors are shown, it will be readily apparent that any desired number could be employed depending on the number of different sizes of sheets which it is desired to arrange in stacks of sheets of the same size.

Referring now to FIG. 3 of the drawings, this shows one complete transfer conveyor and its relation with the feed conveyor 10, the stacking apparatus 15 and the reject bin 16. The transfer conveyor is basically an elongated manifold 18 supplied with air under pressure from a blower indicated at 20 and supporting a plurality of Bernoulli nozzle members 22 the details of which are shown in my co-pending application Ser. No. 450,770 filed Mar. 13, 1974 now U.S. Pat. No. 3,880,297. The nozzles 22 are arranged in a common plane which is inclined at about a 6° angle to the horizontal in order that sheets once removed from the feed conveyor 10 and suspended in non-contacting relationship by the nozzles will slide by gravity from a position overlying the feed conveyor 10 to the end of the transfer conveyor. Air flow to groups of the nozzles is controlled by a simple valving arrangement which includes a plurality of simultaneously actuable valves 24 to open or close the passageways from the manifold 18 to the nozzles 22. As shown in this figure, these nozzles are arranged in groups such as 26 and 28 overlying respectively the feed conveyor 10 and the reject bin 16.

Referring now to FIGS. 2 and 3 it will be noted that the feed conveyor 10 at the location of the transfer conveyors 12 and 14 is tilted so that the plane of the sheets being conveyed thereon is parallel to the plane of the nozzles of the transfer conveyors.

Due to the momentum of sheets on the feed conveyor 10, it is necessary to provide a stop means on that side of the transfer conveyors which is downstream of the path of travel of the feed conveyor. It was found that a stationary abutment for this purpose created a drag against movement of the sheets along the transfer conveyors and in order to overcome this, a moving abutment in the form of a driven belt was provided as shown at 32 and 34. The linear velocity of the belt is substantially matched to that of the sheets as they slide downhill beneath the transfer conveyors and the lower edge of the belt is spaced between the upper surface of the feed conveyor and the plane of the nozzles.

OPERATION

As the different size sheets progress along the feed conveyor 10, the nozzles on the transfer conveyors must be programmed to operate at the proper time. While conceivably this could be done manually, it would be preferable to have an interlocking control circuit which would be constantly reprogrammed by means of an operator typing into a keyboard as in the well known mail sorting machines. In any event, in referring to FIG. 1 of the drawings, the valves in the transfer conveyor 12 should all be closed until the two large sheets 36 and 38 are positioned beneath the conveyor 12. At that point, and assuming that both sheets 36 and 38 are to be stacked, all of the nozzles in the transfer conveyor 12 should be actuated by opening all of the valves to permit air under pressure from the manifold 18 to flow out of the nozzles 22 to pick the sheets up off the feed conveyor 10. Both will then slide by gravity while suspended by the nozzle until they are positioned over the reject bin at which point in time the valves are opened, they will fly in a parabolic trajectory until the sheets come to rest on the top of the stack. In the event that one or the other of these two sheets had been determeined to be defective, then when that sheet was positioned over the reject bin 16, the valves in section 28 would be momentarily closed to permit that sheet to fall into the bin 16. Each of the valve sections are automatically closed following passage of a sheet or a group of sheets thereover. For reasons that are not completely understood, the spacing between the sheets in the direction of travel below the transfer conveyors gradually increases which seems to add to the rapidity and smoothness of stacking over the arrangement of my prior application Ser. No. 552,288 filed Feb. 24, 1975 when the transfer conveyor extends all the way to the stack. Also, this gives clear access to each stack for visual inspection and removal of any defective sheets which somehow got past the reject bin.

The smaller sheets indicated at 40, 42, 44, 46 and 48 will pass by the transfer conveyor 12 on the feed conveyor 10 because the valves in the conveyor 12 will all be closed at that time. The valves in conveyor 14, however, will be opened upon the arrival of the sheets at that conveyor where they will be removed as a group by the first set of nozzles 26. If any are defective, they will be dropped into the bin 16 but the remainder will proceed on to the stacking means as before.

The stacking means 14 automatically lowers with the addition of each sheet on the top of the stack as is fully described in my aforementioned co-pending application Ser. No. 450,770 and the control of the height of the stack may be photoelectric. As soon as one stack is full, the entire operation is stopped to permit the removal of the accumulated stack of sheets and resetting of the stack receiving means.

From the foregoing it will be apparent to those skilled in this art that there is herein shown and disclosed a new and useful form of sheet stacking apparatus and while a preferred embodiment has been illustrated and described, the applicant claims the benefit of a full range of equivalents within the scope of the appended claims.

I claim:

1. Sheet conveying, separating and stacking apparatus comprising:

a. a feed conveyor for conveying a plurality of sheets horizontally in side-by-side relation to each other in a first straight line direction;

b. at least one transfer conveyor arranged at substantially right angles to said feed conveyor, overlying said feed conveyor and extending outwardly and inclined slightly downwardly therefrom, said transfer conveyor including a manifold supporting on its underside, a plurality of nozzles in a common plane, each nozzle including passageways for directing air under pressure parallel to said common plane and valve means for selectively establishing fluid communication between groups of said nozzles and the interior of said manifold;

c. a stack receiving means positioned beyond that end of said transfer conveyor which is remote from said feed conveyor;

d. a reject bin positioned beneath said transfer conveyor between said stacking means and said feed conveyor;

e. said feed conveyor including means for changing the plane of travel of sheets thereon from horizontal to a plane substantially parallel to the plane of said nozzles at the location of said transfer conveyor; and f. means for pressurizing said manifold; whereby operation of said valve means is effective to selectively pick up sheets from said feed conveyor, support them in closely spaced non-contacting relation with respect to said nozzles and permit them to slide down said incline while so supported and to be dropped either into said reject bin or permitted to fly free from the end of said transfer conveyor to said stack receiving means.

2. Apparatus as defined by claim 1 including a plurality of said transfer and stacking conveyors spaced from each other along the direction of travel of said feed conveyor and a corresponding plurality of stack receiving means and reject bins one each associated with each of said transfer conveyors respectively.

3. Apparatus as defined by claim 1 including a driven endless belt having one flight extending along that side of said transfer conveyor which is downstream of said feed conveyor, the plane of said flight being substantially perpendicular to the plane of said nozzles and having its lower edge positioned between the plane of said nozzles and the upper surface of said feed conveyor and traveling in the same direction as said transfer conveyor.

4. Apparatus as defined by claim 2 including in association with each said transfer conveyor a driven endless belt having one flight extending along that side of said transfer conveyor which is downstream of feed conveyor, the plane of said flight being perpendicular to the plane of said nozzles and having its lower edge positioned between the plane of said nozzles and the upper surface of said feed conveyor and traveling in the same direction as said transfer conveyor.

* * * * *